US008015865B2

(12) United States Patent
DeFilipp

(10) Patent No.: US 8,015,865 B2
(45) Date of Patent: Sep. 13, 2011

(54) WIND TURBINE FOUNDATION MONITORING SYSTEM

(75) Inventor: Patrick Anthony DeFilipp, Auburn, ME (US)

(73) Assignee: Reed & Reed, Inc., Woolwich, ME (US)

( * ) Notice: Subject to any disclaimer, the term of this patent is extended or adjusted under 35 U.S.C. 154(b) by 70 days.

(21) Appl. No.: 12/580,807

(22) Filed: Oct. 16, 2009

(65) Prior Publication Data

US 2010/0095603 A1 Apr. 22, 2010

Related U.S. Application Data

(60) Provisional application No. 61/106,232, filed on Oct. 17, 2008.

(51) Int. Cl.
*G01M 9/00* (2006.01)

(52) U.S. Cl. ..... 73/147; 416/61

(58) Field of Classification Search ..... None
See application file for complete search history.

(56) References Cited

U.S. PATENT DOCUMENTS

| | | | | |
|---|---|---|---|---|
| 3,747,400 | A * | 7/1973 | Finsterwalder | 73/768 |
| 2008/0232906 | A1 | 9/2008 | Henderson | |
| 2009/0039650 | A1 * | 2/2009 | Nies | 290/44 |
| 2009/0169380 | A1 * | 7/2009 | Nies et al. | 416/61 |

* cited by examiner

*Primary Examiner* — Andre Allen
(74) *Attorney, Agent, or Firm* — Patricia M. Mathers

(57) ABSTRACT

A load measuring system for measuring the loads on a foundation for wind turbines is disclosed. A load measuring device is mounted on a rock anchor pad for a turbine and measures the loads on the anchor. Signals from the load measuring device are transmitted to a remote location. The load measuring device is installed on selected rock anchor pads, distributed evenly about the foundation pad. The signals from the load measuring are transmitted to a control station at a remote location, thereby enabling continuous monitoring of the loading conditions on the rock anchors. The signals from a plurality of load measuring systems may be transmitted to the control station, so as to allow monitoring of a group of wind turbine foundation pads at a single location.

3 Claims, 4 Drawing Sheets

WIND TURBINE FOUNDATION MONITORING SYSTEM

BACKGROUND INFORMATION

1. Field of the Invention

The invention relates to monitoring systems in foundations for heavy installations. More particularly, the invention relates to systems that monitor the anchors for a wind turbine anchored in a anchored pad foundation.

2. Description of the Prior Art

Wind turbines are mounted on foundation pads that are anchored in the ground. The turbines are subjected to heavy loading, which may cause the anchors to fail. The foundation pad may settle, which may also result in failure of the anchors. The anchor systems are regularly monitored, to ensure safety. Monitoring is done by visiting each foundation pad and checking each anchor. This is time-consuming and costly, and also not optimal, because the foundation sites are, at best, monitored at regularly scheduled intervals, rather than on a continuously on-going basis.

What is needed therefore is a monitoring system for the rock anchors on wind turbine foundation pads that is cost-effective and that provides continuous monitoring.

BRIEF SUMMARY OF THE INVENTION

The invention is a foundation monitoring system that is installed in an anchored pad foundation of a wind turbine, to continuously monitor the effectiveness of the anchored pad foundation. The anchored pad foundation construction includes a foundation pad, with rock anchors that are anchored deep in the rock ledge beneath the foundation pad. U.S. Patent Application Publication 2008/00232906 A1 discloses such an anchored pad foundation, and the subject matter of that prior art reference is incorporated herein by reference, for purposes of illustrating an anchored pad foundation that is suitable for monitoring by the foundation monitoring system of the present application. It is understood, that the foundation monitoring system according to the invention may be used on various types and embodiments of foundations for wind turbines that use rock or pile anchors to anchor a wind turbine to subterranean ledge, i.e., is not limited to use on the type of foundation disclosed in the above cited Application Publication.

The foundation monitoring system comprises a set of load cells that continuously monitor the condition and status of a pile or rock anchor, with the output of the load cells coupled to a monitoring system. A load cell is installed beneath the rock anchor lock nut on designated rock anchors around the foundation. The load cell continuously transmits signals indicating the tensile load on the respective rock anchor. The signals from the load cells are transmitted to a remote control system in real time, thereby enabling continuous, real-time monitoring of the loads on the rock anchors. Alarms and/or analysis reports may be generated, based on the transmitted data.

The foundation monitoring system monitors multiple rock anchors on a single anchored pad foundation. Ideally, four or more rock anchors that are distributed with approximately even spacing from each other on the anchored pad foundation are selected to be monitored. If settlement to the foundation or failure of any one or more of the monitored rock anchors occurs, the load cells will detect the variance in loading and transmit that information. It is not necessary to install load cells on each and every rock anchor in the anchored pad foundation. If one of the rock anchors that is not being monitored fails, the loading on the other anchors will increase and the failure be detected in that way.

The foundation monitoring system may encompass monitoring of multiple rock anchors on a single foundation or on multiple foundations in a project or wind turbine farm, or even multiple foundations of turbines from multiple projects installed over a large geographic area. For example, a control room located at some remote location may display in graph form or other form the loads on the monitored rock anchors of all wind turbines that are installed on anchored pad foundations in the greater New England area. The foundation monitoring system thus enables local, project-related, or regional monitoring of wind turbine installation conditions and, furthermore, eliminates costly and time-consuming performance testing of the individual rock anchors. The monitoring system will also allow the facility operator to monitor the loads on the rock anchors induced by severe weather conditions, such as a hurricane, earthquake, etc.

The foundation monitoring system may also be combined with other safety or security systems. For example, temperature or other types of sensors, and/or video cameras and other security devices may be piggybacked onto the foundation monitoring system.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
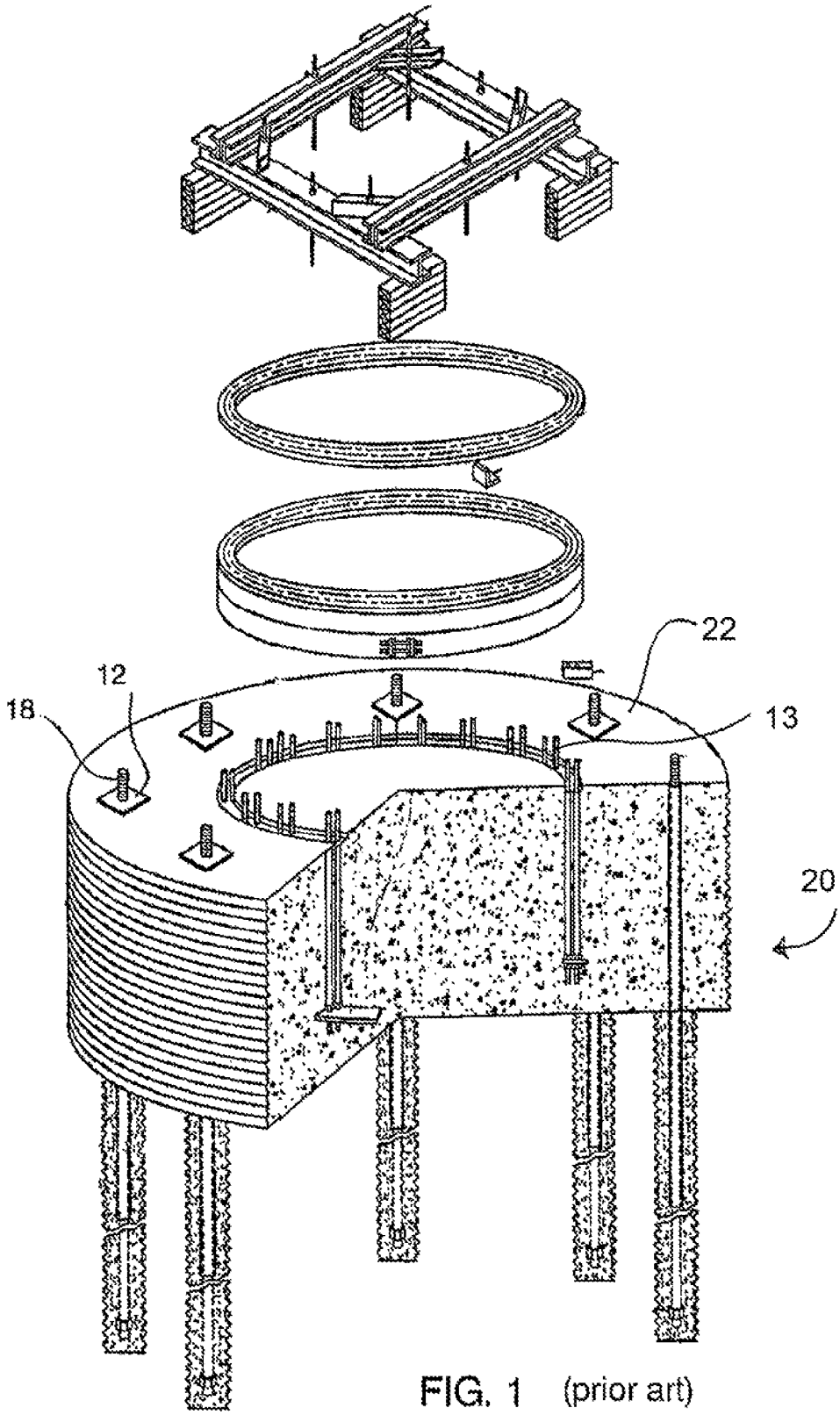
FIG. 1 (prior art)
FIG. 1 is an exploded view of an anchored pad foundation. (Prior Art)

FIG. 1 (prior art) illustrates a known anchored pad foundation for a wind turbine, which comprises a foundation pad 22, a rock or pile anchor 18 and two concentric rings of bolts 13. This illustration provides an overview of an anchored pad foundation and is not per se part of the invention claimed in the present application.

Figure 2:
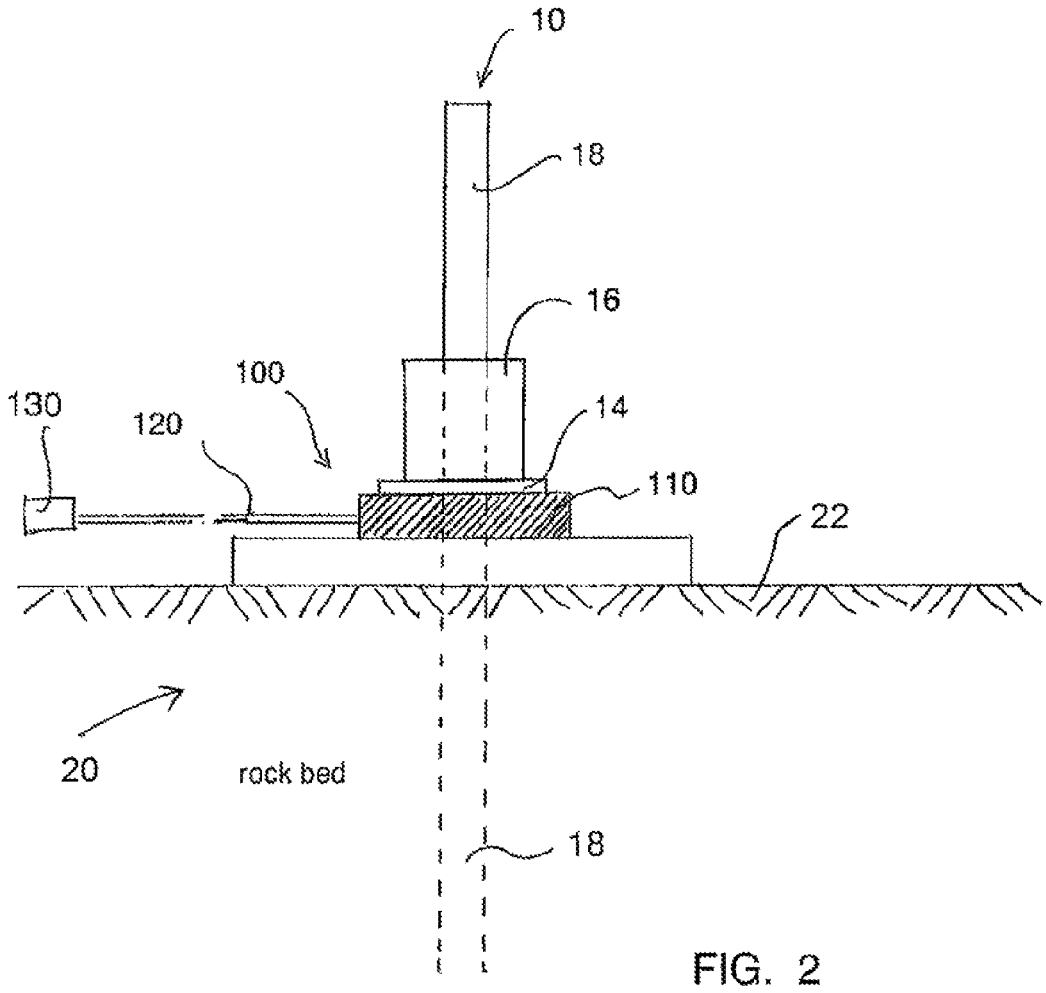
FIG. 2 is a schematic illustration of a load measuring system installed according to the invention to monitor loads on a rock anchor.

FIG. 2 illustrates a load measuring system 100 for measuring the tensile load on a rock or pile anchor that anchors a wind turbine (not shown) to an anchored pad foundation 20. The anchored pad foundation 20 is not shown in any detail herein, beyond what is shown in FIG. 1. An anchor system 10 is used to anchor the wind turbine to underground ledge or rock R. The conventional anchor system 10 includes a rock or pile anchor 18, an anchor lock nut 16, a washer 14 and an anchor base plate 12. The anchor base plate 12 is installed on a concrete foundation cap 22 of the anchored pad foundation

20 and the load measuring system 100 assembled on the base plate 12. The rock anchor 18 is inserted through the load measuring system 100, the anchor base plate 12, and the washer 14, and 16 then threaded onto the rock anchor 18. The load measuring system 100 comprises a load cell or other transducer or sensor 110 that is mounted directly onto the anchor base plate 12 and that sends electrical signals via signal cables 120 to a signal transmission means 130. An example of a suitable transducer 110 is a thru-hole load washer load cell, LWO Series, capacity 2,400-300,000 lbs, provided by Transducer Techniques, Inc., Temecula, Calif. Once assembled, the rock anchor 18 is post-tensioned to some specified load and the transducer 110 transmits signals that correspond to the magnitude of deviations in the specified load.

Figure 3:
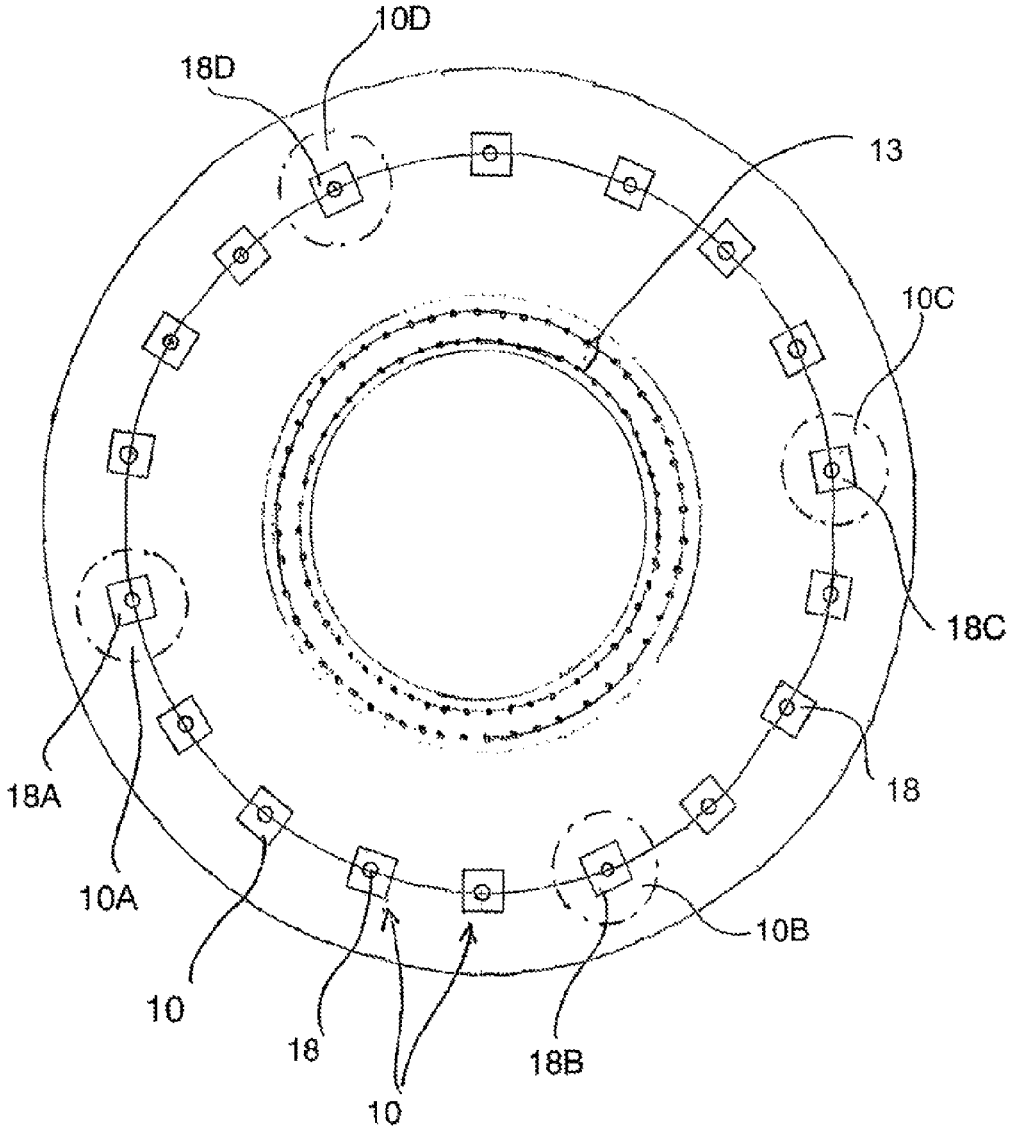
FIG. 3 is a top plane view of the foundation pad, showing the rock anchors and use of load cells to monitor loads on a plurality of rock anchors and selection of rock anchors to be monitored.

FIG. 3 is a schematic illustration of the foundation cap 22, showing the arrangement of a plurality of rock anchor systems 10. In this particular illustration, the number of rock anchors 18 is eighteen and it is understood, that the number of rock anchors on a pad may vary. Of the eighteen rock anchors 18, a total of four rock anchors 18A-18D have been selected for tensile load monitoring by the foundation monitoring system 100 according to the invention. Accordingly, the load measuring system 100 is installed on each of the selected rock anchors 10A-10D. The primary forces exerted on the anchor system 10 are the compressive force of the weight of the turbine, overturning forces, with one side of the rock anchor in compression and the other side in tension, and tension forces caused by settlement of the foundation. Measuring the tensile forces on the rock anchors 18A-18D will provide an accurate indication of the condition and status of the foundation system for the wind turbine. The relatively even distribution of the load measuring system 100 about the foundation pad 22 ensures that, even though the load measuring system 100 is not installed on all rock anchors 18, they nevertheless provide clear data on the status and condition of the foundation as a whole and for each of the rock anchors 18.

Figure 4:
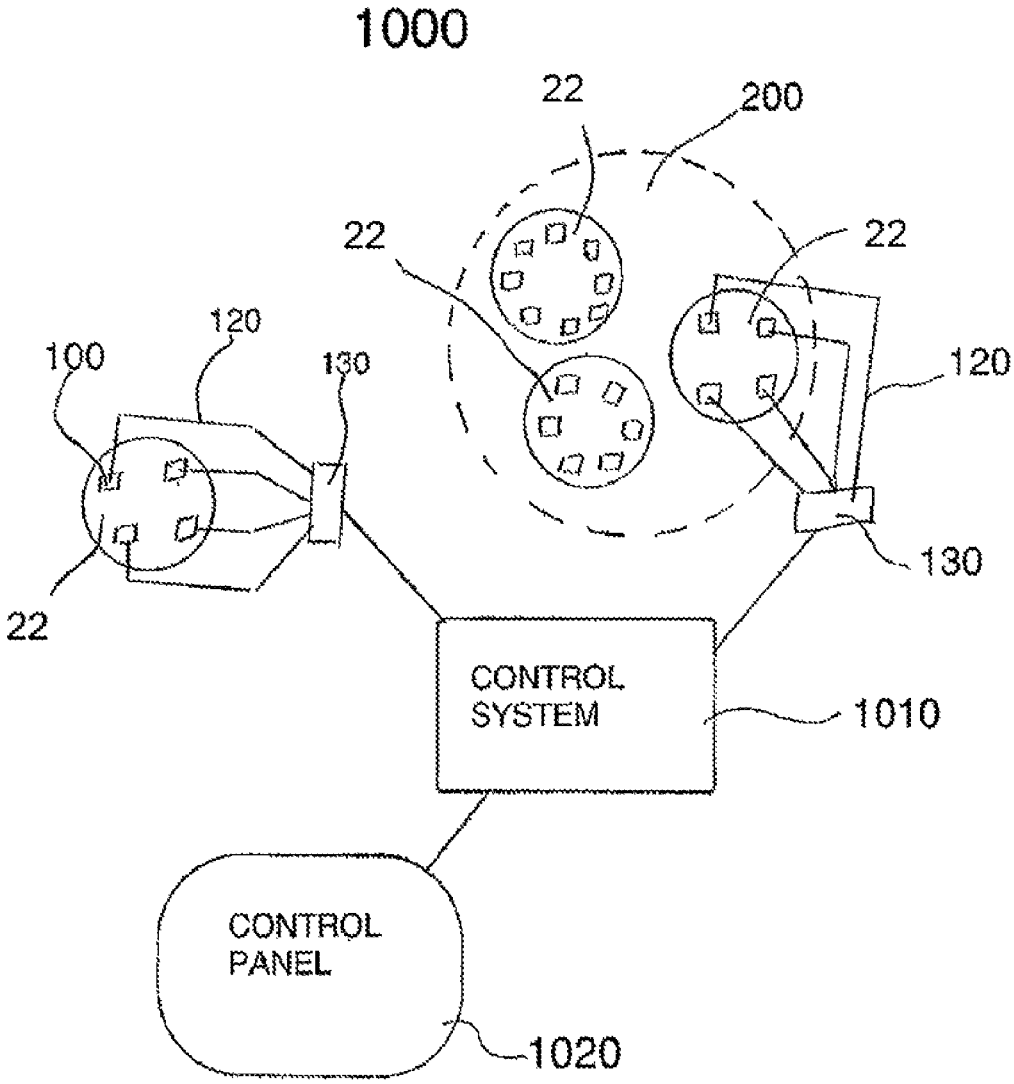
FIG. 4 is a block diagram of the foundation monitoring system according to the invention.

FIG. 4 is a block diagram of the foundation monitoring system 1000 for the anchored pad foundations 20. Multiple wind turbine foundations 20 are shown, each with a number of load measuring systems 100 installed on selected rock anchors 18, whereby each load measuring system 100 is connected via a transmission means 130 with a control system 1010 that is remotely located from the anchored pad foundations 20. The transmission means 130 may be any suitable means of transmission, including wired or wireless telecommunication systems. An agglomeration 200 of anchored pad foundations 20 as well as individual anchored pad foundations feed data into the control system 1010. The data is displayed on a control panel 1020 at one or more work stations.

It is understood that the embodiments described herein are merely illustrative of the present invention. Variations in the construction of the load measuring system and the foundation monitoring system may be contemplated by one skilled in the art without limiting the intended scope of the invention herein disclosed and as defined by the following claims.

What is claimed is:

1. A foundation monitoring system for measuring loads on a rock anchor system that supports a wind turbine, the foundation monitoring system comprising:

a rock anchor system comprising a foundation cap, a rock anchor that extends through the foundation cap, with an upper portion that extends above the foundation cap and a lower portion that extends below the foundation cap and is anchorable to bedrock, an anchor base plate that is fitted over the upper portion of the rock anchor, atop the foundation cap, a washer and an anchor lock nut that are fastened to the upper portion of the rock anchor, so as to apply a tensile load to the rock anchor;

a load measuring device for measuring tensile load on the rock anchor, the load measuring device including a load sensor for sensing forces exerted on the rock anchor, wherein the load measuring device is mounted between the anchor base plate and the washer;

signal emitter means for emitting a signal that indicates a condition of loading as sensed by the load measuring device;

a signal transmission means for transmitting the signal; and a control system for receiving and displaying said signals on a computer;

wherein signals indicating the condition of loading are transmitted via the signal transmission means from the load measuring device to the control system at a remote location.

2. The foundation monitoring system of claim 1, wherein the rock anchor system includes a plurality of rock anchors, each one fitted with the anchor base plate, the washer and the lock nut, and wherein the load measuring system is mounted on selected ones of the plurality of rock anchors.

3. The foundation monitoring system of claim 1, wherein the load measuring system includes a load cell that records tensile load on the rock anchor.

* * * * *